US005860609A

United States Patent [19]

Sommer et al.

[11] Patent Number: 5,860,609

[45] Date of Patent: Jan. 19, 1999

[54] WEAR-RESISTANT SURFACE ARMORING FOR THE ROLLS OF HIGH-PRESSURE ROLL PRESSES FOR THE PRESSURE DISINTEGRATION OF GRANULAR MATERIAL

[75] Inventors: Erich Sommer; Ludger Alsman, both of Cologne; Gustav Buchholz, Kerpen; Franz Goeddecke, Leverkusen; Meinhard Frangenberg, Kuerten, all of Germany

[73] Assignee: Deutz Aktiengesellschaft, Koln, Germany

[21] Appl. No.: 932,719

[22] Filed: Sep. 18, 1997

[30] Foreign Application Priority Data

Sep. 19, 1996 [DE] Germany ..... 196 38 237.8

[51] Int. Cl.[6] ..... B02C 4/30

[52] U.S. Cl. ..... 241/293; 241/294; 241/300

[58] Field of Search ..... 241/293, 294, 241/300, 227

[56] References Cited

U.S. PATENT DOCUMENTS

| | | | |
|---|---|---|---|
| 1,736,563 | 11/1929 | Wilmot | 241/294 |
| 2,678,652 | 5/1954 | Bryant, Jr. | 241/294 |
| 2,919,075 | 12/1959 | Pfeiffer | 241/160 |
| 3,241,777 | 3/1966 | Kuntz | 241/300 |
| 3,827,642 | 8/1974 | Sageman | 241/101.7 |
| 5,203,513 | 4/1993 | Keller et al. | 241/30 |
| 5,269,477 | 12/1993 | Buchholtz et al. | 241/293 |
| 5,735,471 | 4/1998 | Muro | 241/23 |

FOREIGN PATENT DOCUMENTS

| | | |
|---|---|---|
| 0 578 239 | 1/1994 | European Pat. Off. . |
| 0 516 952 | 12/1995 | European Pat. Off. . |

*Primary Examiner*—John M. Husar
*Attorney, Agent, or Firm*—Hill & Simpson

[57] ABSTRACT

In order to create a wear-resistant surface armoring suited for autogenous wear protection for the rolls of high-pressure roll presses for pressure disintegration of granular material using nap bolts (grid armoring), which also comprises a high serviceable life span even under the effect of high-pressure loads, it is proposed to give the nap bolt the shape of a mushroom, whose head projects outward from the roll body and whose shaft is sunk into the corresponding recess or bore of the roll body in such a way that an open space remains between the base of the bore and the lower end of the shaft of the bolt.

18 Claims, 4 Drawing Sheets

WEAR-RESISTANT SURFACE ARMORING FOR THE ROLLS OF HIGH-PRESSURE ROLL PRESSES FOR THE PRESSURE DISINTEGRATION OF GRANULAR MATERIAL

BACKGROUND OF THE INVENTION

The invention relates to a wear-resistant surface armoring for the rolls of high-pressure roll presses for the pressure disintegration of granular material, having a plurality of nap bolts that are made of hard material and are mounted in corresponding recesses of the roll body, which bolts project from the roll body and form between themselves pockets for the acceptance of pressed-together fine granular material.

In rolling crushers and roll mills, brittle material to be crushed is drawn into the nip that separates the two rotatably mounted rolls from one another, which rolls can be rotated in directions opposed to one another, and is there subjected to pressure disintegration. What is referred to as interparticle crushing in the nip of a high-pressure roll press is also known, in which the individual particles of the material to be crushed, drawn into the nip by friction, are mutually crushed in a bed of material, i.e., in a grist pressed together between the two roll surfaces with the application of a high pressure. Of course, the roll surfaces are thereby exposed to extraordinarily high stress and a high degree of wear.

It is therefore known to make the surfaces of interparticle crushing roll presses resistant to wear by mounting a plurality of pin-shaped nap bolts at spaced intervals in blind holes in the roll body, which bolts project in the manner of spikes from the holes in the roll body (EP-B-0 516 952, U.S. Pat. No. 5,269,477, FIG. 2). The pin-shaped nap bolts should thereby project outward from the roll surface at such a height, and should be arranged at such a spacing from one another, that during operation of the roll press the intermediate spaces or pockets on the roll surface between the pin-shaped nap bolts remain filled with the pressed-together fine granular material, forming what is known as an autogenous wear protection for the roll surfaces. However, during operation of a high-pressure roll press armored in this way, the danger cannot be entirely excluded that damages can arise in the coating surface of the roll by means of the formation of fissures as a result of the high pressure that acts on the notch points present in the recesses/bores of the roll body via the pin-shaped nap bolts, in particular given laterally acting forces, which damages cause a shortening of the serviceable life of the armoring.

It has also already been proposed (EP-A-0 578 239) in rolled armorings with pin-shaped nap bolts of the type described above, to fashion the radially inner (lower) ends of the nap bolts with a hemispherical or dome shape, and to let the nap bolts be supported with these shaped ends on correspondingly hemispherical blind hole ends of the recesses provided in the roll body, in order to reduce the influence of notch tensions. However, the expense for the manufacture of dome-shaped blind hole ends and bolt ends of this sort is not inconsiderable; a snug seating of the bolt end in the correspondingly shaped blind hole base must be ensured; and, moreover, the pin-shaped nap bolt with its hemispherical end in its blind hole can tend to tip under the action of the high roll pressure force. Moreover, with the use of previously known nap bolts, due to their relatively small diameter, it cannot be excluded that the material to be processed becomes "coiled around" the bolts during roll press operation, particularly in case of a higher degree of dampness of the material to be processed. This has an adverse effect on the dispersion characteristic of the material being pressed, and can cause erosion of the base material between the nap bolts.

SUMMARY OF THE INVENTION

The underlying aim of the invention is thus to create a surface armoring for the rolls of high-pressure roll presses for the pressure disintegration of granular material, which armoring is resistant to wear and is suited for autogenous wear protection with the use of the nap bolt grid armoring technique, in which the portion of the hard metal nap bolts, which are highly resistant to wear, is increased, and the dispersion behavior of the material being pressed is ensured even in case of high material dampness, and the risk of breakage is reduced even when higher pressure forces are in effect.

This aim is solved according to the invention wherein the nap bolts each have a shaft with an enlarged head thereon, in the configuration of a mushroom, the head projecting outwardly from the roll body, and the shaft being sunk into the recess of the roll body, such that an open space remains between a base of the recess and a lower end of the shaft of the bolt opposite the head.

It is characteristic for the inventive surface armoring for the rolls of high-pressure roll presses for the pressure disintegration of granular material using the grid armoring nap bolt technique that the nap bolts embedded in the roll body in the manner of spikes respectively have the shape of a mushroom, which respectively projects outward with its head from the roll body and whose shaft is fixed in the corresponding recess or bore of the roll body in such a way that a free space remains between the base of the bore and the lower end of the shaft of the bolt. That is, in the inventive surface armoring, the nap bolts are not supported on the roll body with their radial inner (lower) bolt end, but rather exclusively with the bolt head or, respectively, mushroom head, which is wider in comparison to the shaft of the bolt. The nap bolt head reduces the tendency of the bolt to tip in its respective blind hole bore of the roll body.

Precisely because the nap bolts are not supported with their radially inner ends in the roll body, fits between the radially inner bolt ends and the base of the bore, which are expensive to manufacture, are avoided. Rather, in the inventive surface armoring, the recesses to be made in the roll body can be blind holes with standard conical bore bases, easily manufacturable with a borer. In the inventive mushroom naps, the diameters or, respectively, support surfaces of the nap heads, which are larger in comparison to the previously known pin naps, lead to lower surface pressure, which likewise contributes to a prolongation of the serviceable life of the mushroom nap bolts.

Because the mushroom-shaped heads of the nap bolts have a wider cross-section, or, respectively, diameter, than the respective bolt shaft, the open spaces between adjacent bolt heads are narrowed, and therewith the intermediate spaces or pockets remaining between the bolt heads, which spaces are supposed to be filled with the pressed-together fine granular material as a means for protection against wear during operation of the roll press, whereby the dispersion and holding of the material pressed into the pockets is favored, and, on the other hand, the portion of hard metal in the overall surface armoring is increased. On the other hand, the mushroom-shaped bolt heads make it possible to use fewer bolts while maintaining a determined size of the intermediate spaces or pockets between adjacent bolts on the surface of the roll, whereby the number of bolts required per surface unit can be reduced and corresponding boring processes can be saved.

The support surface of the nap bolt head on the roll body can be flush with the roll surface. However, this support surface of the nap bolt head is advantageously recessed or sunk in a separate roll body head recess. In this way, the nap bolt head, projecting with its upper part from the roll body, can be anchored very securely in the roll body, both with respect to the pressure stress of the bolt head in the radial direction and also in the direction of the circumference of the roll.

BRIEF DESCRIPTION OF THE DRAWINGS

The invention and further features and advantages thereof are explained in more detail on the basis of the exemplary embodiments represented schematically in the figures.

DETAILED DESCRIPTION OF THE PREFERRED EMBODIMENTS

Figure 1:
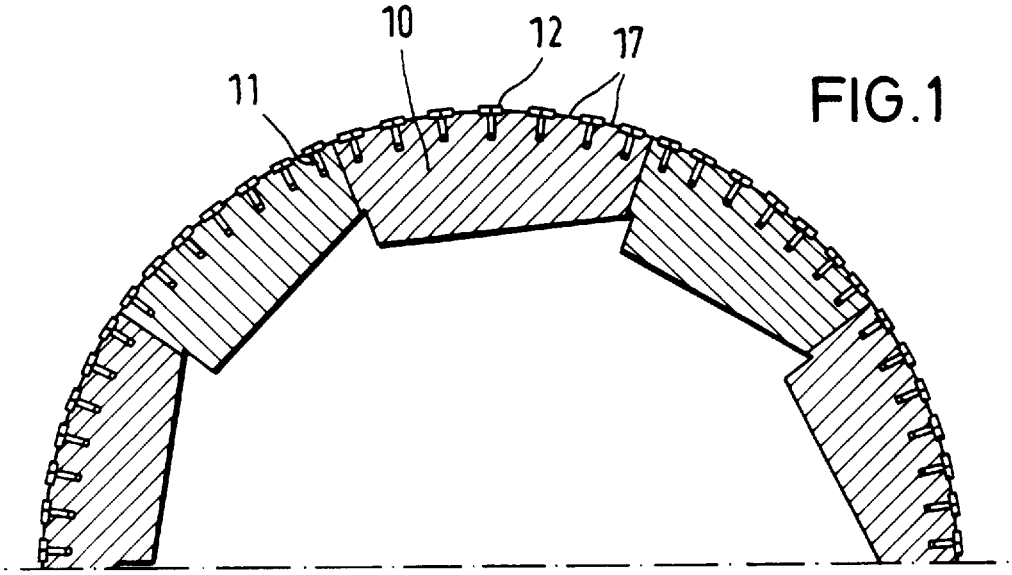
FIG. 1 shows, in a vertical section transverse to the roll axis, the inventive surface armoring for the roll of a high-pressure roll press, with a plurality of mushroom-shaped nap bolts arranged on the roll surface.

In the exemplary embodiment in FIG. 1, the roll body 10 is composed of several segments bolted detachably to the base roll body. The roll surface or, respectively, the roll body 10 comprises a plurality of recesses or bores oriented approximately radially, in which nap bolts 11 made of a hard material are fixed, which protrude with their head 12 from the roll surface, forming between them pockets 17 for the reception of pressed-together fine granular material during the pressure disintegration of granular material. Instead of segments, the nap bolts 11 can also be placed in an annular binding, or also directly in the base roll body.

Figure 2:
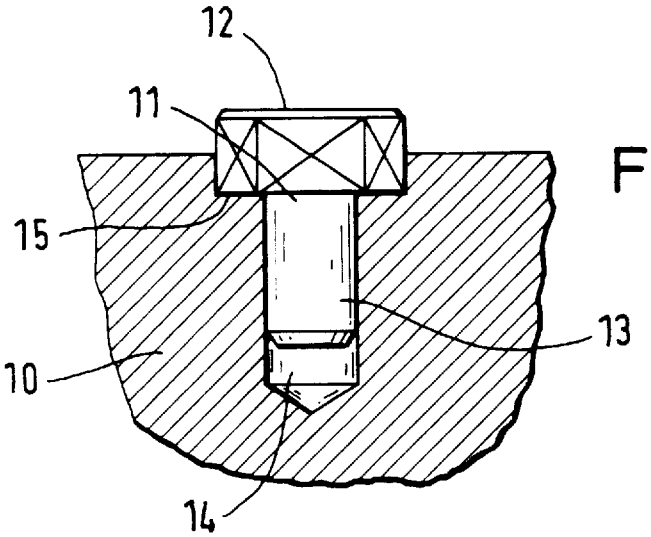
FIG. 2 shows an enlarged view of one of the mushroom-shaped nap bolts used in the roll of FIG. 1.
Figure 3:
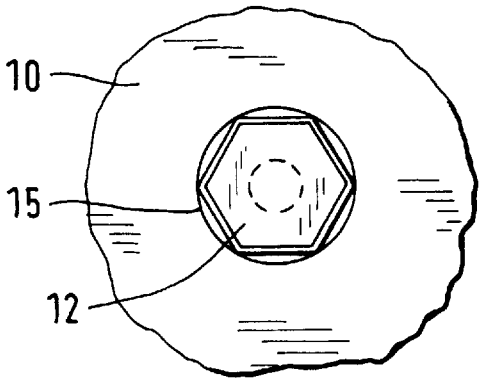
FIG. 3 shows a top view of the nap bolts of FIG. 2.
Figure 4:
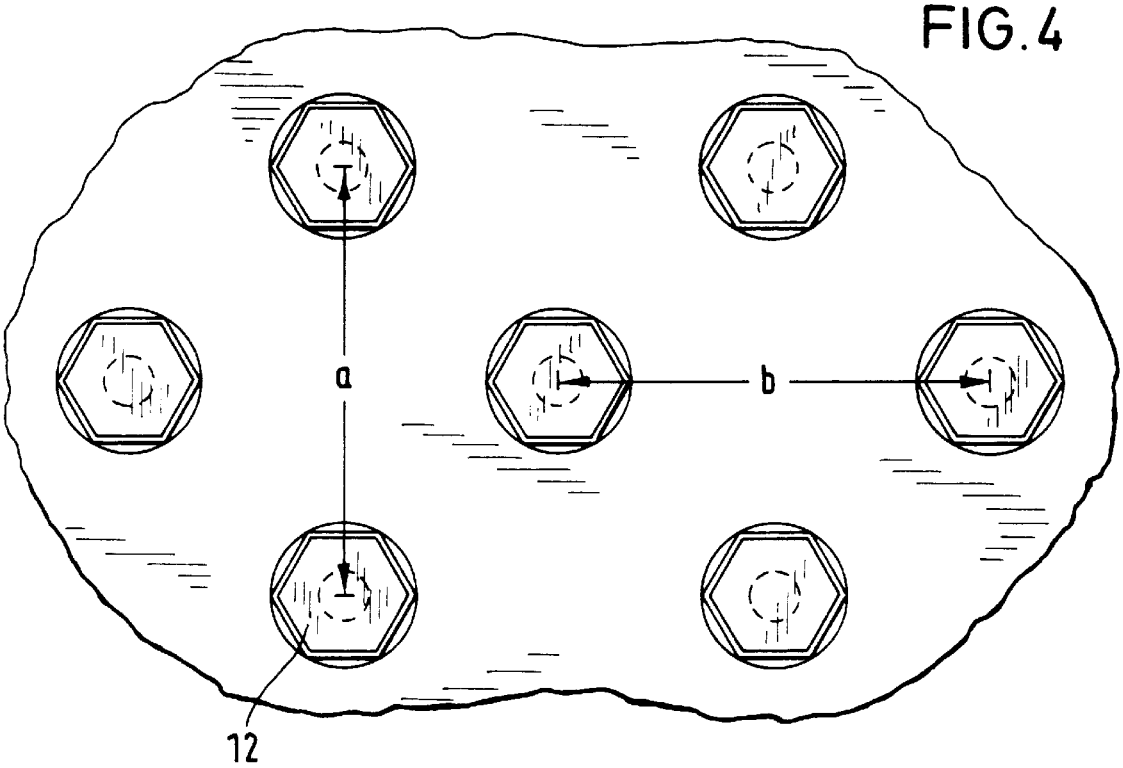
FIG. 4 shows a top view of several nap bolts of FIG. 3 placed adjacently in the roll body.

As can be seen clearly from FIG. 2, the nap bolts 11 have the configuration of a mushroom, whose head 12, which is hexagonal in the exemplary embodiments of FIGS. 2–4, projects outward from the roll body 10, and whose shaft 13 is inserted into the corresponding bore of the roll body 10 in such a way that an open space 14 remains between the base of the bore and the lower end of the shaft of the bolt. In any case, it is supposed to be ensured that the nap bolts 11 are supported in a corresponding head recess 15 of the roll body 10 not with their shaft 13, but rather with their head 12. The nap bolt head 12 may lie flush on the surface of the roll body 10 or may be partly let in or sunk into the roll body, by which means the nap bolt is secured very well against tipped positions both in the radial direction and also in the direction of the circumference of the roll. In addition, it is also advantageous that the nap bolt head 12 reduces the surface pressing on the base body 10 during the use of the roll for pressure disintegration of granular material, due to the enlarged dimensions of its surface.

Figure 6:
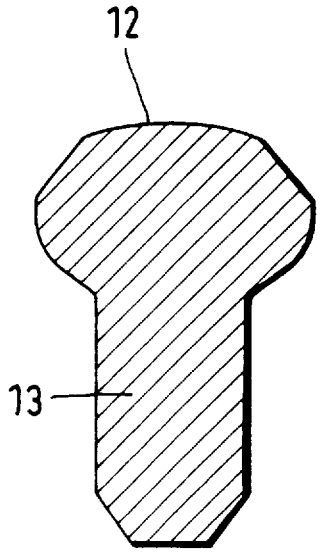
FIG. 6 shows an enlarged view of a mushroom-shaped nap bolt with a curved head in the shape of the cap of a mushroom.
Figure 7:
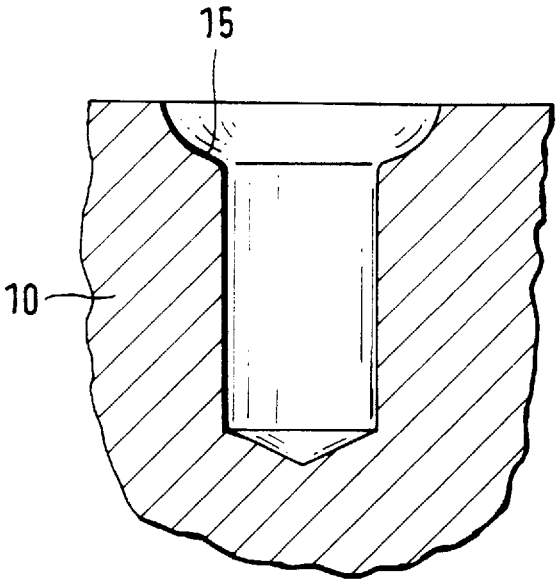
FIG. 7 shows a segment of the recess or bore in the roll body for the reception of the mushroom nap of FIG. 6.

According to FIG. 2, the roll body head recess 15 for receiving the nap bolt head 12 comprises a flat bearing surface. According to the exemplary embodiment of FIG. 7, this support surface 15 can also have the shape of the envelope of a cone, and the support surface may also have been fashioned in the shape of a spherical dome. The nap bolt head 12, seen in a top view, is round according to the exemplary embodiment in FIG. 5, rectangular to square according to FIG. 8, and is, for example, hexagonal according to FIGS. 1–4. The upper side of the nap bolt head 12 is flat, or, according to FIG. 6, is curved in the shape of a cap of a mushroom.

Figure 5:
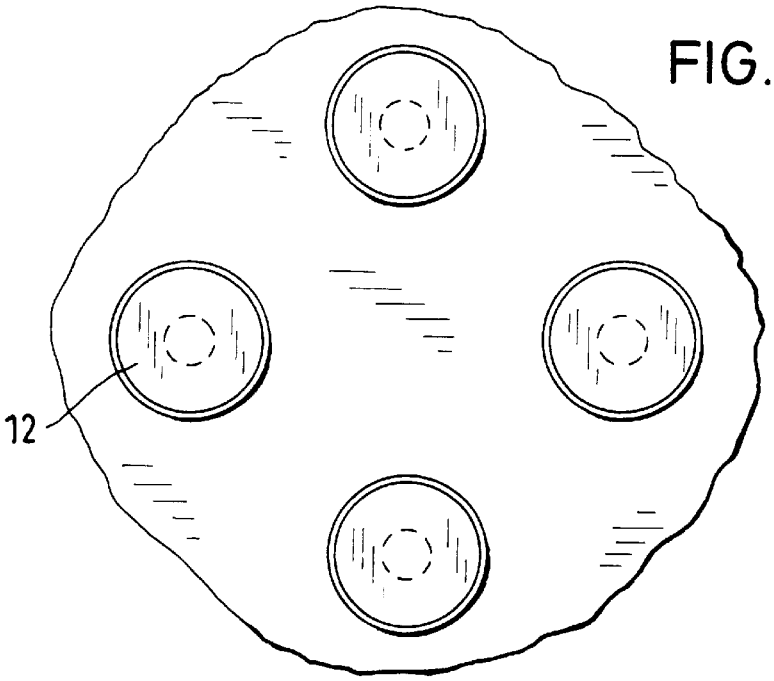
FIG. 5 shows a top view of several adjacent mushroom-shaped nap bolts with round heads.
Figure 8:
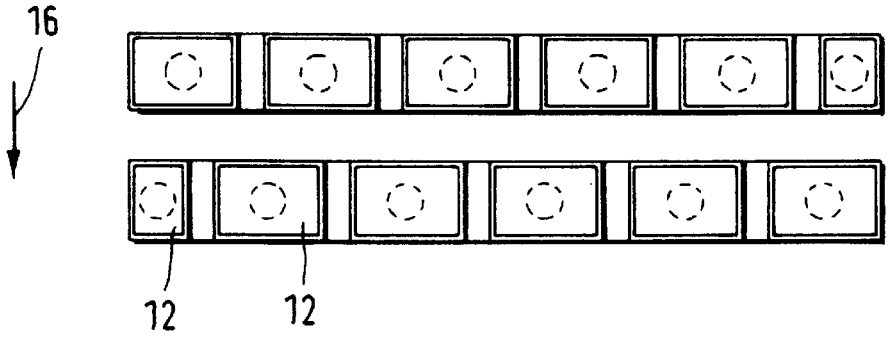
FIG. 8 shows a top view of two adjacent rows of nap bolts with rectangular heads lying along lines of the roll coating.

FIGS. 4, 5, and 8 show that adjacent rows of mushroom nap bolts arranged along roll coating lines are respectively displaced to one another with gaps, whereby the problem of the formation of channels for the material compressed in the region of the narrowest nip is reduced, seen in the direction of rotation 16 of the roll, during operation of the roll press with pressure disintegration of granular material, whereby the draw-in characteristic and the dispersion of pressed material between the mushroom naps is improved. According to the exemplary embodiments in FIGS. 4 and 5, the spacing "a" of the adjacent mushroom nap bolts, seen in the direction of the circumference of the roll or the direction of rotation 16, is the same size as the spacing "b" of the adjacent mushroom nap bolts, seen in the direction of the axis of the roll. The spacing "a" is advantageously smaller than the spacing "b", in an approximate ratio of from 1:1 to about 1:2.

Figure 9:
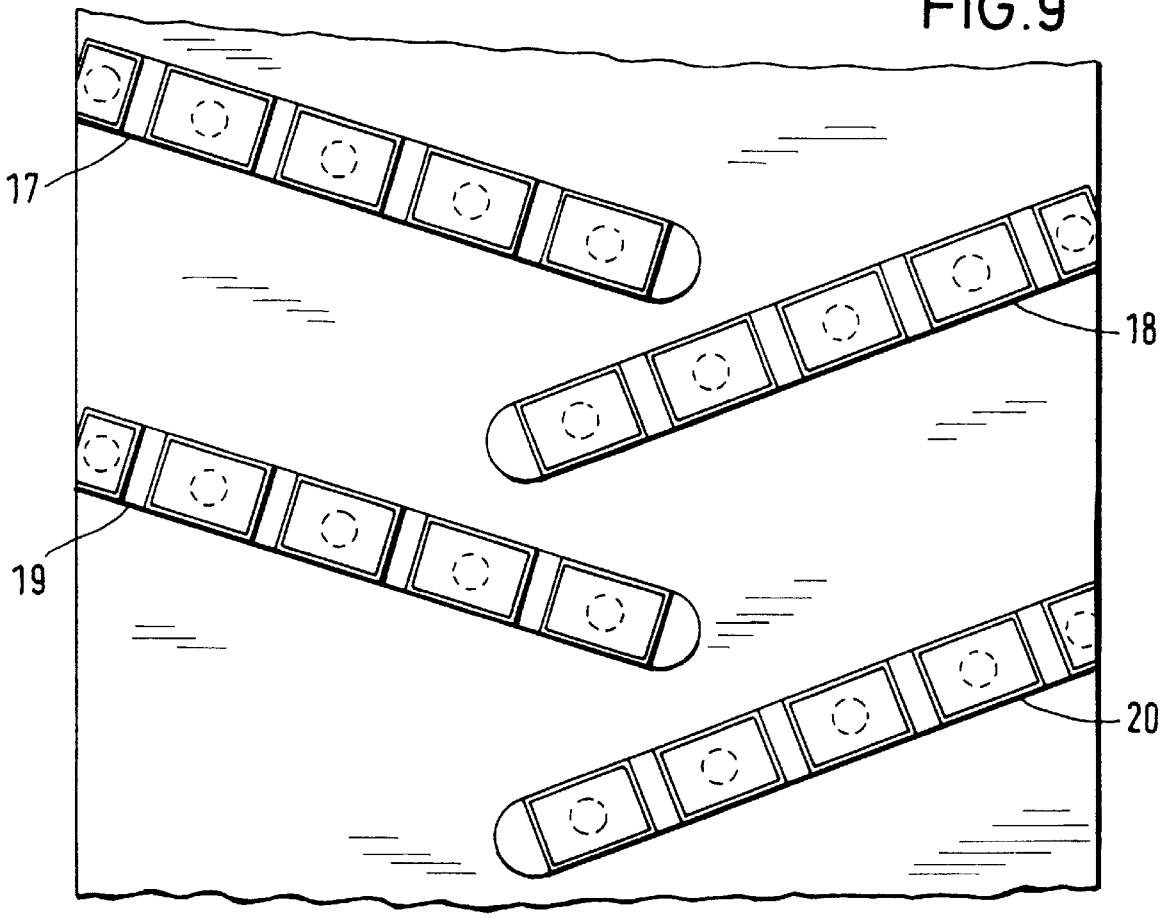
FIG. 9 shows a top view of a roll surface with rows of nap bolts with rectangular heads arranged in the shape of a V.

According to the exemplary embodiment of FIG. 9, the nap bolt rows 17, 18, 19, 20 run at an angle to the roll coating lines, seen in the direction of the circumference of the roll, and they are arranged in the shape of a V, whereby the conditions for the drawing of the material to be subjected to pressure disintegration into the nip during operation of the roll press can be further improved.

The connection between the nap bolt shaft 13 or, respectively, bolt head 12 and the respective roll body bore can take place by means of gluing, pressing, shrinking, etc.

The height of the bolt heads 12 projecting radially outward from the roll surface is chosen according to the type of material being pressed, and can be, e.g., up to 10 mm. Adjacent nap bolt heads 12 are arranged at a spacing from one another of less than approximately 40 mm, so that the intermediate spaces or pockets 17 formed between the bolt heads 12 on the roll surface in the area of the roll surface are narrow enough that during interparticle crushing operation of the press roll, these pockets 17 between the bolt heads 12 are filled with one and the same pressed-together material resulting from interparticle crushing, which material is of fine granularity but is highly compressed, and which remains held in these pockets during the rotations of the roll, i.e., the material pressed into the intermediate spaces or pockets 17 between the bolt heads 12 from the outside, and which remains there securely, forms an ideal autogenous protection against wear.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

We claim as our invention:

1. Surface armoring for use on rolls of high-pressure roll presses which are used for pressure disintegration of granular material, said rolls being provided with a plurality of nap bolts fixed in corresponding recesses in a surface of a body of the roll and consisting of hard material, which bolts project out from said roll body and form between themselves pockets for receiving pressed-together fine granular material, said surface armoring comprising nap bolts each having a shaft with an enlarged head thereon, in a configuration of a mushroom, said head projecting outward from said roll body, and said shaft being sunk into said recess of said roll body, such that an open space remains between a base of said recess and a lower end of said shaft of said bolt opposite said head.

2. Surface armoring according to claim 1, wherein a support surface of said nap bolt head on the roll body is flush with said roll surface.

3. Surface armoring according to claim 1, wherein a support surface for said nap bolt head on the roll body is recessed in a roll body head recess in said roll body surface.

4. Surface armoring according to claim 3, wherein said roll body head recess for receiving said nap bolt head comprises a flat bearing surface.

5. Surface armoring according to claim 3, wherein said roll body head recess for receiving said nap bolt head comprises a cone envelope shaped bearing surface.

6. Surface armoring according to claim 3, wherein said roll body head recess for receiving said nap bolt head comprises a spherical dome shaped bearing surface.

7. Surface armoring according to claim 1, wherein said nap bolt head has a round circumference.

8. Surface armoring according to claim 1, wherein said nap bolt head has a polygonal circumference.

9. Surface armoring according to one of claim 1, wherein an upper side of said nap bolt head is flat.

10. Surface armoring according to one of claim 1, wherein an upper side of said nap bolt head is curved in the shape of a cap of a mushroom.

11. Surface armoring according to claim 1, wherein adjacent mushroom nap bolts are formed into rows arranged along roll coating lines and are displaced relative to one another by gaps.

12. Surface armoring according to claim 11, wherein a spacing of adjacent mushroom nap bolts, seen in a direction of a circumference or rotation of said roll, is no greater than a spacing of adjacent mushroom nap bolts seen in a direction of an axis of said roll.

13. Surface armoring according to claim 12, wherein a spacing of adjacent mushroom nap bolts, seen in said direction of said circumference of said roll, is smaller than a spacing of adjacent mushroom nap bolts seen in said direction of said axis of said roll, in a ratio of 1:1 to about 1:2.

14. Surface armoring according to claim 1, wherein seen in a direction of a circumference of said roll, said nap bolts are arranged in rows which run at an angle to roll coating lines and are arranged in a V-shape.

15. Rolls used in high-pressure roll presses for pressure disintegration of granular material having generally cylindrical bodies with an outer-surface, comprising recesses in said surface formed with side walls and a base wall, nap bolts each having a shaft with an enlarged head thereon, said shaft being sunk into one of said recesses in said surface such that an open space remains between said base wall of said recess and a lower end of said shaft of said bolt opposite said head, and said head projects outward from said outer surface.

16. Rolls according to claim 15, wherein adjacent nap bolts are formed into rows and are displaced relative to one another by gaps and wherein a spacing of adjacent nap bolts, in a direction of a circumference or rotation of said roll, is no greater than a spacing of adjacent nap bolts in a direction of an axis of said roll.

17. Rolls according to claim 15, wherein adjacent nap bolts are formed into rows and are displaced relative to one another by gaps and wherein a spacing of adjacent nap bolts, seen in a direction of a circumference of said roll, is smaller than a spacing of adjacent nap bolts seen in a direction of an axis of said roll, in a ration of 1:1 to about 1:2.

18. Rolls according to claim 15, wherein, in a direction of a circumference of said roll, said nap bolts are arranged in rows which run at an angle to an axis of said roll and are arranged in a V-shape.

* * * * *